US011712902B2

(12) United States Patent
Murayama

(10) Patent No.: US 11,712,902 B2
(45) Date of Patent: Aug. 1, 2023

(54) MACHINE LEARNING METHOD, NON-TRANSITORY COMPUTER-READABLE STORAGE MEDIUM STORING MACHINE LEARNING PROGRAM, AND LIQUID DISCHARGE SYSTEM

(71) Applicant: SEIKO EPSON CORPORATION, Tokyo (JP)

(72) Inventor: Toshiro Murayama, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 17/447,631

(22) Filed: Sep. 14, 2021

(65) Prior Publication Data

US 2022/0080741 A1 Mar. 17, 2022

(30) Foreign Application Priority Data

Sep. 17, 2020 (JP) ..... 2020-156118

(51) Int. Cl.

| | |
|---|---|
| ***B41J 29/393*** | (2006.01) |
| ***B41J 2/21*** | (2006.01) |
| ***B41J 2/045*** | (2006.01) |
| ***B41J 2/165*** | (2006.01) |

(52) U.S. Cl.

CPC ..... *B41J 2/2142* (2013.01); *B41J 2/0451* (2013.01); *B41J 2/04581* (2013.01); *B41J 2/16579* (2013.01)

(58) Field of Classification Search

CPC .... B41J 2/0451; B41J 2/16579; B41J 2/2142; B41J 29/393

See application file for complete search history.

(56) References Cited

U.S. PATENT DOCUMENTS

2019/0184722 A1* 6/2019 Knabe ..... B41J 2/2139
2022/0198638 A1* 6/2022 Seki ..... G06T 7/30

FOREIGN PATENT DOCUMENTS

DE 102019208149 A1 * 1/2020 ..... B41J 2/16579
JP 2013-028183 A 2/2013

* cited by examiner

*Primary Examiner* — Julian D Huffman
(74) *Attorney, Agent, or Firm* — Workman Nydegger

(57) ABSTRACT

A machine learning method includes: obtaining a discharge parameter on discharging performed by a liquid discharge head discharging liquid; obtaining an image quality determination result produced by determining a printed image quality; and learning the relationship between the discharge parameter and the image quality determination result. Also, the discharge parameter desirably includes a discharge state value indicating a discharge state of the liquid discharge head and a discharge result value indicating a discharge result of the liquid discharged on a print medium from the liquid discharge head. The machine learning method includes learning the relationship between the discharge state value and the discharge result value, and the image quality determination result.

9 Claims, 8 Drawing Sheets

| Is | Ts | Stt |
|---|---|---|
| 1 | Ntc < Ntx1 | 2: DISCHARGE ABNORMALITY (BUBLES) |
| | Ntx1 ≤ Ntc ≤ Ntx2 | 1: NORMAL |
| | Ntx2 < Ntc ≤ Ntx3 | 3: DISCHARGE ABNORMALITY (FOREIGN OBJECT ADHESION) |
| | Ntx3 < Ntc | 4: DISCHARGE ABNORMALITY (THICKENING) |
| 2 | N/A | 5: DISCHARGE ABNORMALITY |

FIG. 8
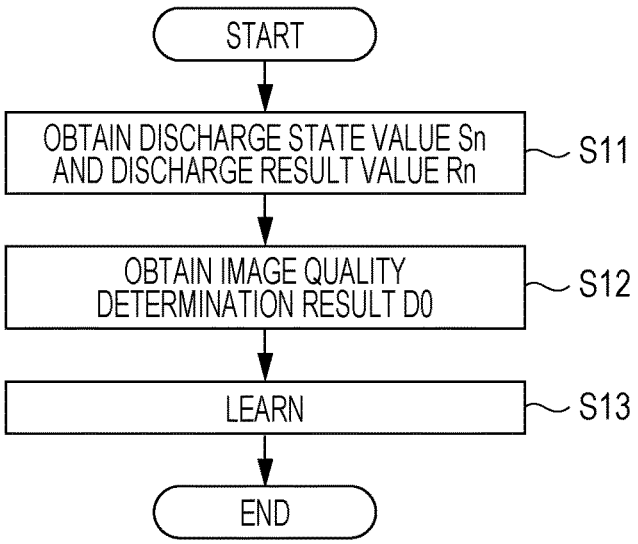
FIG. 9
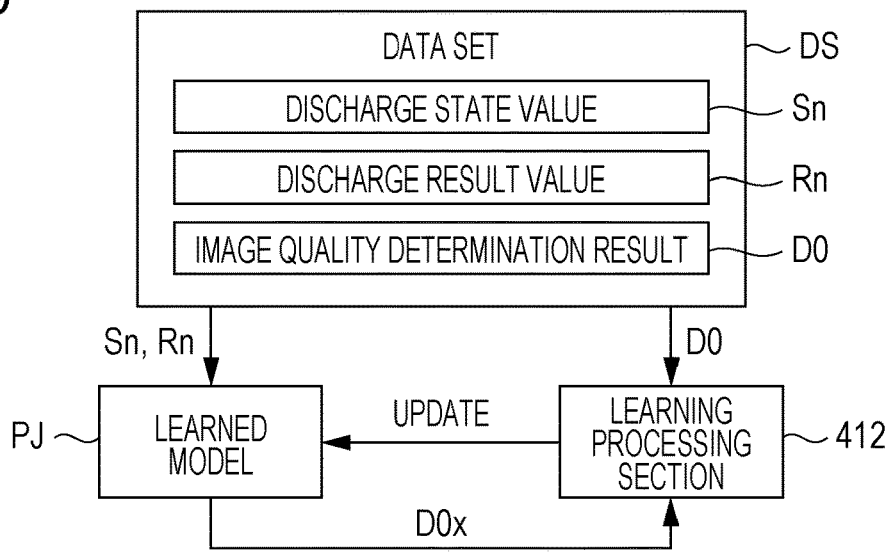
FIG. 10
| | | DETERMINATION OF DISCHARGE ABNORMALITY BASED ON DISCHARGE RESULT VALUE Rn | |
|---|---|---|---|
| | | NORMAL DISCHARGE | ABNORMAL DISCHARGE |
| DETERMINATION OF DISCHARGE ABNORMALITY BASED ON DISCHARGE STATE VALUE Sn | NORMAL DISCHARGE | CORRECT | WRONG |
| | ABNORMAL DISCHARGE | WRONG | CORRECT |

MACHINE LEARNING METHOD, NON-TRANSITORY COMPUTER-READABLE STORAGE MEDIUM STORING MACHINE LEARNING PROGRAM, AND LIQUID DISCHARGE SYSTEM

The present application is based on, and claims priority from JP Application Serial Number 2020-156118, filed Sep. 17, 2020, the disclosure of which is hereby incorporated by reference herein in its entirety.

BACKGROUND

1. Technical Field

The present disclosure relates to a machine learning method, a non-transitory computer-readable storage medium storing a machine learning program, and a liquid discharge system.

2. Related Art

A liquid discharge apparatus, such as an ink jet printer, or the like forms an image by discharging liquid, such as ink, or the like from a plurality of nozzles. The liquid discharge apparatus includes a cavity containing ink, a drive element, and a vibration plate. In general, when a drive pulse is applied to the drive element, the vibration plate is displaced to change the pressure in the cavity so that ink is discharged from a nozzle communicating with the cavity.

In such a liquid discharge apparatus, a discharge abnormality sometimes occurs, for example, by thickening of ink, mixing of bubbles, and the like. In this case, there is a risk of deterioration of the image quality. Thus, methods for detecting a discharge abnormality have been proposed so far.

JP-A-2013-28183 discloses a method of detecting residual vibration of a vibration plate and detecting a discharge abnormality based on a vibration pattern of the residual vibration. A discharge abnormality is determined depending on whether or not the period of the residual vibration is in a predetermined range. When it is determined that the period of the residual vibration is in a predetermined range, the discharging is determined to be normal. On the other hand, when this is not the case, the discharging is determined to be abnormal.

To date, it has been difficult to determine how much effect the occurrence of a discharge abnormality has on the image quality.

SUMMARY

According to an aspect of the present disclosure, there is provided a machine learning method including: obtaining a discharge parameter on discharging performed by a liquid discharge head discharging liquid; obtaining an image quality determination result produced by determining a printed image quality; and learning a relationship between the discharge parameter and the image quality determination result.

According to another aspect of the present disclosure, there is provided a non-transitory computer-readable storage medium storing a machine learning program, the machine learning program causing a computer to perform functions including: obtaining a discharge parameter on discharging performed by a liquid discharge head discharging liquid; obtaining an image quality determination result produced by determining a printed image quality; and learning a relationship between the discharge parameter and the image quality determination result.

According to still another aspect of the present disclosure, there is provided a liquid discharge system including: a learned model obtaining unit that obtains a learned model produced by learning a relationship between a discharge parameter on discharging performed by a liquid discharge head discharging liquid and an image quality determination result produced by determining a printed image quality; a current parameter obtaining unit that obtains a current discharge parameter; and an estimation unit that estimates a quality of an image to be printed by using the learned model based on the current discharge parameter.

BRIEF DESCRIPTION OF THE DRAWINGS

FIG. 8 is a diagram illustrating an example of a learning method performed by a learning device.

FIG. 9 is an explanatory diagram of machine learning for generating a learned model.

FIG. 10 is an explanatory diagram of the combinations of a discharge state value and a discharge result value.

DESCRIPTION OF EXEMPLARY EMBODIMENTS

Figure 1:
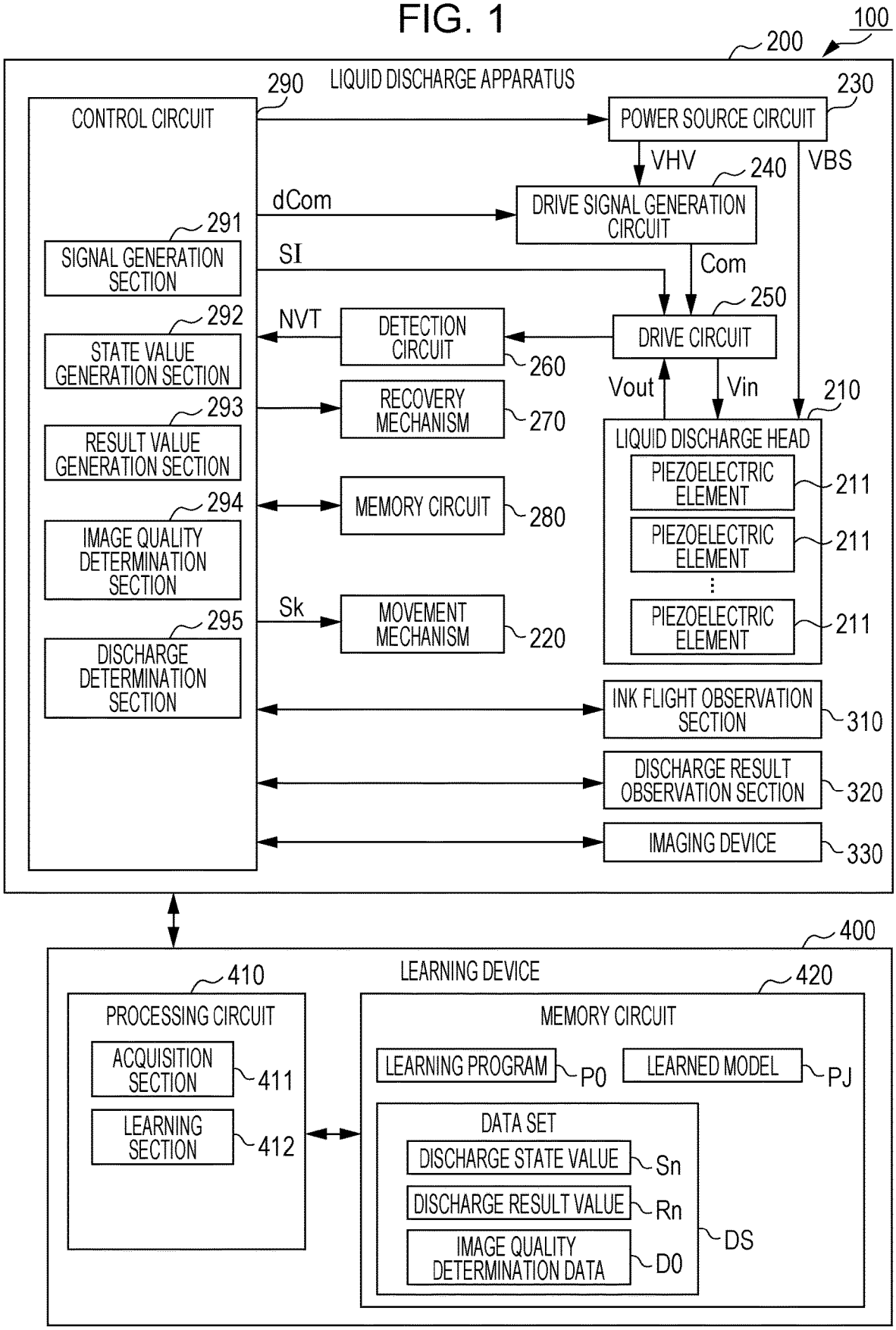
FIG. 1 is a schematic diagram illustrating an example of the configuration of a machine learning system according to an embodiment.

In the following, a description will be given of preferred embodiments according to the present disclosure with reference to the drawings. In this regard, the size or the scale of each section in the drawings may suitably differ from the actual state, and some parts are schematically illustrated to facilitate understanding. Also, the scope of the present disclosure is not limited to those embodiments unless there is a statement that particularly limits the present disclosure in the following description.

1. Machine Learning System 100

1.1 Outline of Machine Learning System 100

FIG. 1 is a schematic diagram illustrating an example of the configuration of a machine learning system 100 according to an embodiment. In the machine learning system 100, the relationship between a discharge condition and an image quality determination result is learned, and a learned model PJ concerning the relationship is generated. It becomes possible to correctly determine an image quality by using the learned model PJ. In this regard, the machine learning system 100 may be regarded as a liquid discharge system that discharges liquid.

As illustrated in FIG. 1, the machine learning system 100 includes a liquid discharge apparatus 200 and a learning device 400. The liquid discharge apparatus 200 and the learning device 400 are connected wirelessly or wiredly in a communicable manner with each other. In this regard, the connection may include a communication network including the Internet. In this regard, in FIG. 1, the learning device 400 is a separate computer from the liquid discharge apparatus 200. However, the learning device 400 may be included in the liquid discharge apparatus 200. Also, the learning device 400 may be disposed in a cloud server. In this case, the liquid discharge apparatus 200 includes the learning device 400. Also, the number of the liquid discharge apparatuses 200 may be one or plural. Accordingly, one learning device 400 may be connected to a plurality of liquid discharge apparatuses 200.

1.1.1 Liquid Discharge Apparatus 200

The liquid discharge apparatus 200 is a printer that prints on a print medium by an ink jet method. The print media are, for example, various types of paper, various types of cloth, various films, or the like. In this regard, the liquid discharge apparatus 200 may be a serial printer or a line printer.

As illustrated in FIG. 1, the liquid discharge apparatus 200 includes a liquid discharge head 210, a movement mechanism 220, a power source circuit 230, a drive signal generation circuit 240, a drive circuit 250, a detection circuit 260, a recovery mechanism 270, a memory circuit 280, and a control circuit 290. Further, the liquid discharge apparatus 200 includes an ink flight observation section 310, a discharge result observation section 320, and an imaging device 330. Also, although not illustrated in FIG. 1, the liquid discharge apparatus 200 includes a communication module that plays the role of communication with the learning device 400. Also, the liquid discharge apparatus 200 may include a display device or an input device.

The liquid discharge head 210 discharges ink onto the print medium. In FIG. 1, a plurality of piezoelectric elements 211, which are examples of drive elements, are illustrated as components of the liquid discharge head 210.

Figure 2:
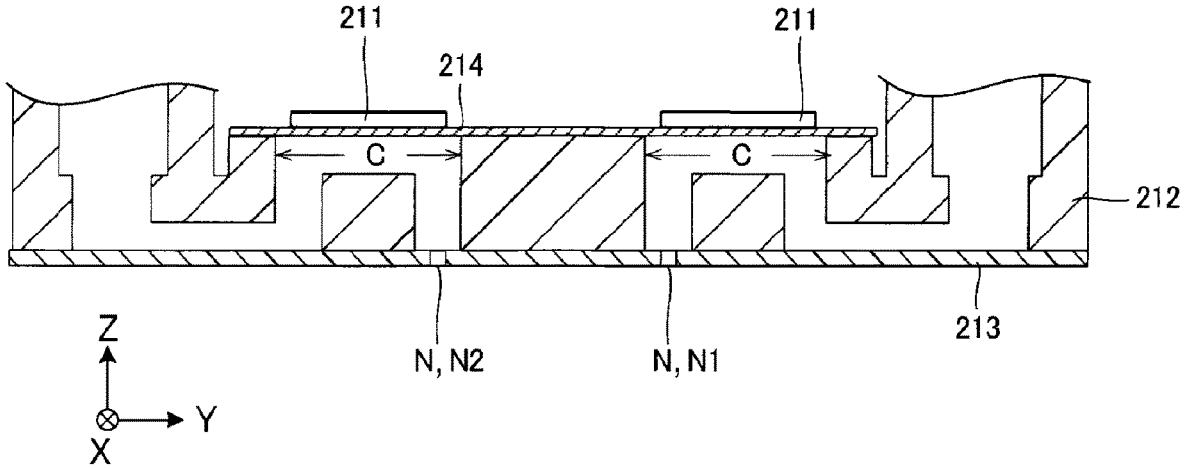
FIG. 2 is a diagram illustrating a part of the liquid discharge head illustrated in FIG. 1.
Figure 3:
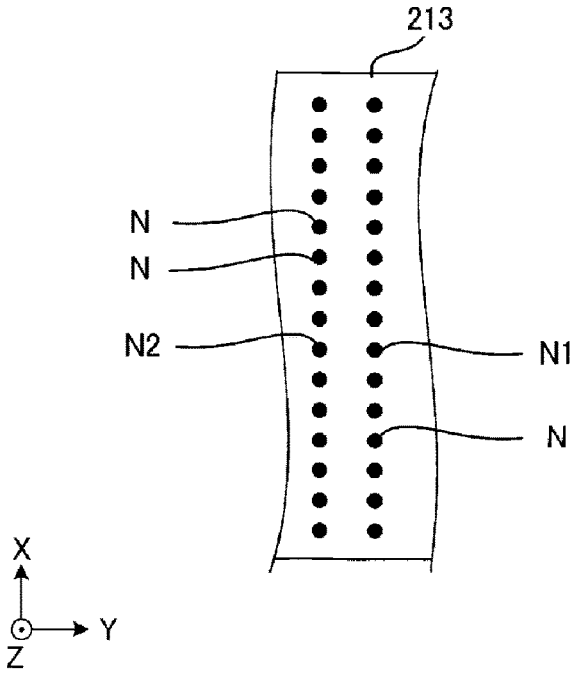
FIG. 3 is a plan view illustrating a part of the nozzle plate illustrated in FIG. 2.

FIG. 2 is a diagram illustrating a part of the liquid discharge head 210 illustrated in FIG. 1. FIG. 3 is a plan view illustrating a part of a nozzle plate 213 illustrated in FIG. 2. In FIG. 2 and FIG. 3, the X-axis, the Y-axis, and the Z-axis are illustrated for convenience of explanation.

As illustrated in FIG. 2, the liquid discharge head 210 includes a structure 212 including a plurality of pressure chambers C, a nozzle plate 213 including a plurality of nozzles N, and a vibration plate 214 disposed on the plurality of pressure chambers C in addition to a plurality of piezoelectric elements 211. The plurality of piezoelectric elements 211 are disposed on the vibration plate 214. The plurality of pressure chambers C are disposed with a one-to-one relationship with the corresponding piezoelectric elements 211. Also, a plurality of pressure chambers C are disposed with a one-to-one relationship with the corresponding nozzles N. The nozzles N communicate with the corresponding pressure chambers C. In the example illustrated in FIG. 3, a plurality of nozzles N are arranged in two lines along the X-axis while being separated from each other. In this regard, in FIG. 3, a first nozzle N1, which is any nozzle N out of the plurality of nozzles N, and a second nozzle N2, which is an adjacent to the first nozzle N1, are illustrated. In this regard, "adjacent" refers to nozzles N that are adjacent to each other without having another nozzle N therebetween. Also, a pressure chamber C corresponding to the first nozzle N1 is a first pressure chamber, and a chamber C corresponding to the second nozzle N2 is a second pressure chamber. Also, a piezoelectric element 211 corresponding to the first nozzle N1 is a first drive element, and a piezoelectric element 211 corresponding to the second nozzle N2 is a second drive element.

In such a liquid discharge head 210, the vibration plate 214 is displaced by driving the piezoelectric element 211. The pressure of the pressure chamber C changes by the displacement so that ink is discharged from the nozzle N corresponding to the pressure chamber C. In this regard, instead of the piezoelectric element 211, a heater that heats the ink in the pressure chamber C may be used as a drive element.

In this regard, in the example illustrated in FIG. 1, the number of the liquid discharge heads 210 of the liquid discharge apparatus 200 is one, but the number of the liquid discharge heads 210 may be two or more.

The movement mechanism 220 illustrated in FIG. 1 changes the relative position between the liquid discharge head 210 and the print medium. Specifically, when the liquid discharge apparatus 200 is a serial type, the movement mechanism 220 includes a transport mechanism that transports a print medium in a predetermined direction and a movement mechanism that repetitively moves the liquid discharge head 210 in an axis perpendicular to the transport direction of the print medium. Also, when the liquid discharge apparatus 200 is a line type, the movement mechanism 220 includes a transport mechanism that transports the print medium in the direction intersecting with the longitudinal direction of the unit including two or more liquid discharge heads 210.

The power source circuit 230 receives power supplied from a commercial power source not illustrated in FIG. 1 and generates predetermined various potentials. The generated various potentials are suitably supplied to the individual sections of the liquid discharge apparatus 200. For example, the power source circuit 230 generates a power source potential VHV and an offset potential VBS. The offset potential VBS is supplied to the liquid discharge head 210. Also, the power source potential VHV is supplied to the drive signal generation circuit 240.

The drive signal generation circuit 240 is a circuit that generates a drive signal Com for driving each of the piezoelectric elements 211 of the liquid discharge head 210. Specifically, the drive signal generation circuit 240 includes, for example, a DA conversion circuit and an amplifier circuit. In the drive signal generation circuit 240, the DA conversion circuit converts a waveform specification signal dCom coming from the control circuit 290 from the digital signal to an analog signal, and the amplifier circuit amplifies the analog signal by using the power source potential VHV coming from the power source circuit 230 so as to generate the drive signal Com.

The drive circuit 250 drives piezoelectric elements 211 under the control of the control circuit 290. In the present embodiment, the drive circuit 250 also functions as a switching circuit. Specifically, the drive circuit 250 switches whether or not to supply a supply drive signal Vin to each of the plurality of piezoelectric elements 211 based on a control signal SI described later. The supply drive signal Vin is a signal having the waveform that is actually supplied to a piezoelectric element 211 out of the waveform included in the drive signal Com. The supply drive signal Vin includes a drive pulse PD described later. Also, the drive circuit 250 switches whether or not to supply an electromotive force of a piezoelectric element 211 to the detection circuit 260 as an output signal Vout for each of the plurality of piezoelectric elements 211. The drive circuit 250 is an IC (integrated circuit) chip that outputs a drive signal and a reference voltage for driving each of the piezoelectric elements 211. In this regard, a description will be given later of the drive pulse PD.

The detection circuit 260 detects a residual vibration that occurs in the pressure chamber C after supplying a drive signal Com to a piezoelectric element 211. Specifically, the detection circuit 260 generates a residual vibration signal NVT based on the output signal Vout that occurs at each of the piezoelectric elements 211. For example, the detection circuit 260 amplifies the output signal Vout after removing noise so as to generate the residual vibration signal NVT. The residual vibration signal NVT is a signal indicating a residual vibration, which is a residual vibration in an ink flow path in the liquid discharge head 210 after driving a corresponding piezoelectric element 211. In this regard, a description will be later given of the residual vibration signal NVT.

The recovery mechanism 270 performs recovery processing for recovering a discharge abnormality under the control of the control circuit 290. The recovery processing includes, for example, flushing processing that discharges ink from a nozzle N for cleaning in the liquid discharge head 210, wiping processing for wiping the nozzle face of a nozzle N, and the like.

The memory circuit 280 stores various programs that are executed by the control circuit 290 and various kinds of data, such as print data, and the like to be processed by the control circuit 290. In this regard, the print data is supplied from an external device not illustrated in FIG. 1. Also, the memory circuit 280 includes one of or both of semiconductor memories of a volatile memory, for example, a RAM (random access memory), and the like, and a nonvolatile memory, such as a ROM (read only memory), an EEPROM (electrically erasable programmable read-only memory), a PROM (programmable ROM), or the like. In this regard, the memory circuit 280 may be configured as a part of the control circuit 290.

The ink flight observation section 310 observes the flight state of the ink discharged from the liquid discharge head 210. The flight state includes, for example, whether or not having discharged, an ink discharge amount, a discharge speed, and the number of satellites. The ink flight observation section 310 includes, for example, a camera including an imaging optical system and an imaging device. The imaging optical system is an optical system including at least one imaging lens and may include, various optical elements, such as a prism, or the like, and may include a zoom lens, a focus lens, or the like. The imaging device is, for example, a CCD (charge coupled device) image sensor, a CMOS (complementary MOS) image sensor, or the like. Also, the ink flight observation section 310 may include a strobe flash light source. Also, the ink flight observation section 310 may include an infrared sensor.

The discharge result observation section 320 observes the impact state of ink impacted on the print medium and obtains the ink state as a discharge result. Specifically, the discharge result includes whether or not ink has impacted, the amount of impact ink, the shape and the area, and the like. The discharge result observation section 320 includes, for example, an imaging device that captures the image of the state of the ink discharged from the liquid discharge head 210 on the print medium. The imaging device includes, for example, an imaging optical system and an imaging device in the same manner as the discharge result observation section 320 described above. Also, the discharge result observation section 320 may include a load cell for measuring the amount of impact ink or an electric resistance measuring device for measuring whether or not ink has impacted.

The imaging device 330 captures the printed image. Specifically, the imaging device 330 is, for example, a camera that captures the image of the printed face of the print medium after printing. The imaging device 330 captures the image of the printed face and generates imaging data. In this regard, the imaging device 330 may include a spectroscopic function. In this case, the imaging device 330 includes, for example, a diffraction grating or a tunable filter in the imaging optical system. The image captured by the imaging device 330 may be full color or monochrome.

The control circuit 290 has a function of controlling the operation of each section of the liquid discharge apparatus 200 and a function of processing various kinds of data. The control circuit 290 includes, for example, a processor, such as one or more CPUs (central processing units), or the like. In this regard, the control circuit 290 may include a programmable logic device, such as an FPGA (field-programmable gate array), or the like instead of the CPU or in addition to the CPU.

The control circuit 290 executes the program stored in the memory circuit 280 so as to control the operation of each section of the liquid discharge apparatus 200. The control circuit 290 executes the program so as to function as a signal generation section 291, a state value generation section 292, a result value generation section 293, an image quality determination section 294, and a discharge determination section 295.

The signal generation section 291 generates signals, such as control signals Sk and SI and a waveform specification signal dCom, and the like as signals for controlling the operation of each section of the liquid discharge apparatus 200. The control signal Sk is a signal for controlling the drive of the movement mechanism 220. The control signal SI is a signal for controlling the drive of the drive circuit 250. Specifically, the control signal SI specifies whether or not the drive circuit 250 supplies a supply drive signal Vin generated from the drive signal Com to the liquid discharge head 210 for each predetermined unit period. By the specification, the amount of ink discharged from the liquid discharge head 210, and the like are specified.

The state value generation section 292 generates a discharge state value Sn indicating the discharge state of the liquid discharge head discharging liquid as one of the discharge parameters regarding the discharge performed by the liquid discharge head. The discharge state includes, for example, residual vibration, ink flight state, discharge history, and the relationship between adjacent nozzles N. The discharge state values Sn indicating the residual vibration are, for example, such as the amplitude, the period, and the vibration duration of residual vibration, or the quantified value of the attenuation rate of the amplitude. The discharge state value Sn indicating residual vibration is generated based on the waveform data of the residual vibration signal NVT. The discharge state value Sn indicating the ink flight state includes, for example, whether or not having discharged, an ink discharge amount, a discharge speed, or the quantified value of the number of satellites. The discharge state value Sn indicating the ink flight state is generated based on the imaging data captured by the ink flight observation section 310. The discharge state value Sn indicating a discharge history is, for example, whether or not the nozzle N has discharged ink in a predetermined period, or the quantified value of the discharge frequency in a predetermined period. The discharge state value Sn indicating discharge history is generated based on the data stored in the memory circuit 280. The discharge state value Sn indicating the relationship between the adjacent nozzles N is, for example, the quantified value of whether or not the second nozzle N2 discharges ink at the time when the first nozzle N1 discharges ink. The discharge state value Sn indicating the relationship between the adjacent nozzles N is generated based on the data stored in the memory circuit 280.

The result value generation section 293 generates a discharge result value Rn indicating the discharge result of the liquid discharged from the liquid discharge head to the print medium as one of the other discharge parameters regarding discharge of the liquid discharge head. The discharge result value Rn includes, for example, whether or not ink has impacted, the amount of ink impacted, a quantified value of shape or area, and the like. The discharge result value Rn is generated based on the discharge result output from the discharge result observation section 320.

The image quality determination section 294 determines the quality of the printed image and generates a quantified value of good or bad, or the degree of image quality as an image quality determination result D0. Whether the image quality is good or bad, or the degree of the image quality is determined by the degree of ink stain, the degree of ink agglutination, or presence or absence of missing dots. Whether the image quality is good or bad or the degree of the image quality may be determined based on the image data of the imaging device 330 or may be determined by using human sensory evaluation.

The discharge determination section 295 determines whether the discharge is normal or abnormal. Specifically, the discharge determination section 295 determines whether or not liquid discharge head 210 has a discharge abnormality based on the discharge state value Sn indicating the residual vibration or the discharge state value Sn indicating the flight state. For example, the discharge determination section 295 compares the period or the amplitude, and the like of the waveform of the residual vibration signal NVT and those of the waveform of the signal indicating the residual vibration at normal time, and determines whether or not there is a discharge abnormality based on the comparison result. Also, for example, the discharge determination section 295 determines whether or not the liquid discharge head 210 has a discharge abnormality based on the discharge result value Rn. Accordingly, the discharge determination section 295 determines whether or not there is a discharge abnormality from each of the discharge state value Sn and the discharge result value Rn.

Also, when there is a discharge abnormality, the discharge determination section 295 identifies an abnormality cause, such as mixing of bubbles, thickening of ink, adhesion of a foreign object to the nozzle N, and the like. In this regard, a discharge abnormality typically refers to non-discharge of ink from the nozzle N, and the like. When a discharge abnormality occurs, a so-called missing dot occurs on a printed image.

1.1.2 Learning Device 400

The learning device 400 learns the relationship between the discharge parameters and the image quality determination result D0. More specifically, the learning device 400 uses the discharge state value Sn and the discharge result value Rn as the discharge parameters and learns the relationship between the discharge state value Sn and the discharge result value Rn, and the image quality determination result D0. The learning device 400 generates a learned model PJ including the relationship between the discharge state value Sn and the discharge result value Rn, and the image quality determination result D0 by supervised machine learning using the discharge state value Sn and the discharge result value Rn, which are the discharge parameters, and the image quality determination result D0 as the teaching data.

As illustrated in FIG. 1, the learning device 400 includes a memory circuit 420 and a processing circuit 410. These circuits are coupled by a transmission line and are communicable with each other. In this regard, although not illustrated in FIG. 1, the learning device 400 includes a communication module that establishes a connection to the liquid discharge apparatus 200. Also, the learning device 400 may include a display device or an input device.

The memory circuit 420 is a device that stores various programs to be executed by the processing circuit 410 and various kinds of data processed by the processing circuit 410. The memory circuit 420 includes, for example, a hard disk drive or a semiconductor memory. In this regard, a part of or all of the memory circuit 420 may be disposed in a storage device, a server, or the like outside the learning device 400. In this regard, a part of or all of the various programs and the various kinds of data described above may be stored in a storage device, a server, or the like outside the learning device 400.

The memory circuit 420 includes a machine learning program P0, a plurality of data sets DS, and a learned model PJ. The data sets DS include a plurality of discharge state values Sn, a plurality of discharge result values Rn, and the image quality determination results D0. The plurality of discharge state values Sn and the corresponding discharge result values Rn are associated with each other in a one-to-one relationship. The discharge state values Sn and the discharge result values Rn exist for each of the nozzles N. The discharge state values Sn and the discharge result values R are obtained for any nozzle N out of the plurality of nozzles N of the liquid discharge head 210. Also, the plurality of discharge state values Sn and the corresponding discharge result values Rn are associated with the corresponding image quality determination results D0.

The processing circuit 410 is a device having a function of controlling each section of the learning device 400 and a function of processing various kinds of data. The processing circuit 410 includes a processor, for example, a CPU, or the like. In this regard, the processing circuit 410 may be configured by a single processor or a plurality of processors. Also, a part of or all of the functions of the processing circuit 410 may be realized by hardware, such as a DSP, an ASIC (application specific integrated circuit), a PLD (programmable logic device), an FPGA (field programmable gate array), or the like.

The processing circuit 410 reads the machine learning program P0 from the memory circuit 420 and executes the machine learning program P0. By the execution, the processing circuit 410 functions as an acquisition section 411 and a learning section 412.

The acquisition section 411 receives input of the data sets DS. That is to say, the acquisition section 411 receives input of the discharge state values Sn, the discharge result values Rn, and the image quality determination results D0. The learning section 412 learns the relationship between the discharge state values Sn and the discharge result values Rn, and the image quality determination results D0 based on data sets DS, and generates a learned model PJ.

Accordingly, the machine learning program P0 causes the learning device 400, which is a computer, to function to obtain the discharge state values Sn, the discharge result values Rn, and the image quality determination results D0 and to learn the relationship between the discharge state values Sn and the discharge result values Rn, and the image quality determination results D0.

1.2 Drive Pulse PD of Drive Signal Com

Figure 4:
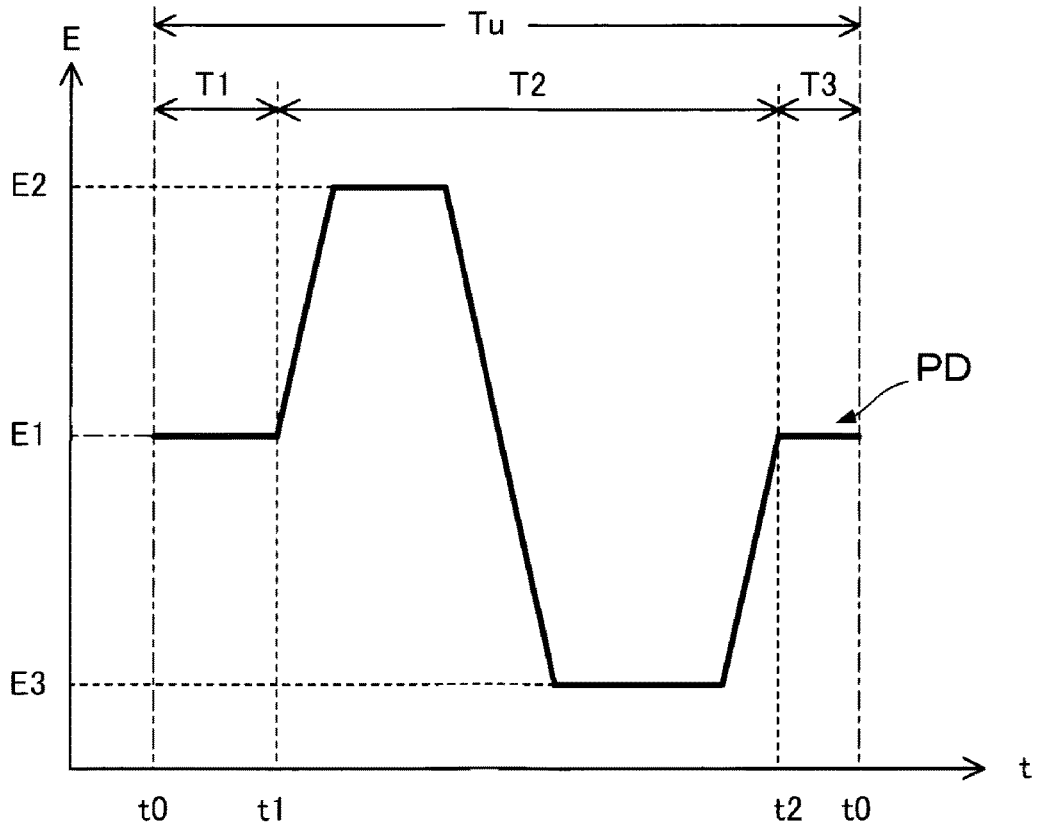
FIG. 4 is an explanatory diagram of an example of a drive pulse of a drive signal.

FIG. 4 is an explanatory diagram of an example of the drive pulse PD of the drive signal Com. As illustrated in FIG. 4, the drive signal Com includes the drive pulse PD and is repeated in a unit period Tu. A unit period Tu is divided into a first period T1, a second period T2, and a third period T3. The potential in the first period T1 and the third period T3 is a reference potential E1. In the second period T2, the potential rises from the reference potential E1 to a potential E2, is maintained at the potential E2, and then drops from the potential E2 to a potential E3, is maintained at the potential E3, and then rises to the reference potential E1.

It is assumed that the volume of the pressure chamber C in the first period T1 is a reference volume. In the second period T2, the volume of the chamber C increases from the reference volume, is maintained at the increased state, and then the volume of the pressure chamber C suddenly decreases. The volume change in the pressure chamber C discharges a part of the ink in the pressure chamber C as droplets. After that, in the second period T2, the decreased state of the volume in the pressure chamber C of the liquid discharge head 210 is maintained, and after the volume of the pressure chamber C increases, the volume returns to the reference volume. The change of the volume in the pressure chamber C suppresses the vibration of the meniscus caused by the discharge of ink from the nozzle N.

The second period T2 is a period for discharging ink from the nozzle N. The third period T3 is a period after discharging ink. The third period T3 is used for a period for detecting the discharge state for obtaining the discharge state value Sn. For example, the third period T3 is used for a period for detecting residual vibration as the discharge state. In this regard, when the drive pulse PD is repeated in the unit period Tu, the first period T1 is also used for detecting the discharge state in addition to the third period T3. For example, in a case of continuous discharge, in which ink is discharged repeatedly, in the first period T1 and the third period T3, which are connecting period of the second period T2, the residual vibration is detected.

In this regard, the drive pulse PD illustrated in FIG. 4 is an example, and the waveform shape of the drive pulse PD is not limited to the example illustrated in FIG. 4.

1.3 Residual Vibration and Abnormality Determination Using Residual Vibration

Figure 5:
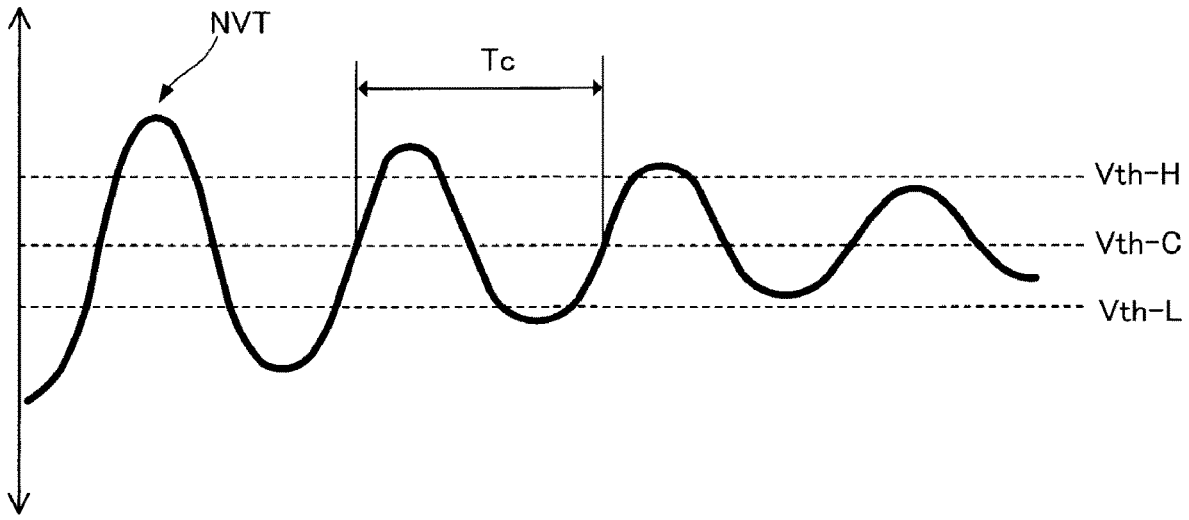
FIG. 5 is an explanatory diagram of an example of residual vibration.

FIG. 5 is an explanatory diagram of an example of the residual vibration. The residual vibration signal NVT is a signal illustrating the residual vibration. The residual vibration is the vibration of a natural frequency, which is determined by the flow path resistor of the flow path in which the ink in the liquid discharge head 210 flows, the inertance of the ink in the flow path, the elastic compliance of the vibration plate 214, and the like. Here, the residual vibration of the vibration plate 214 is equivalent to the residual vibration of the ink in the pressure chamber C.

Figures 6, 7:
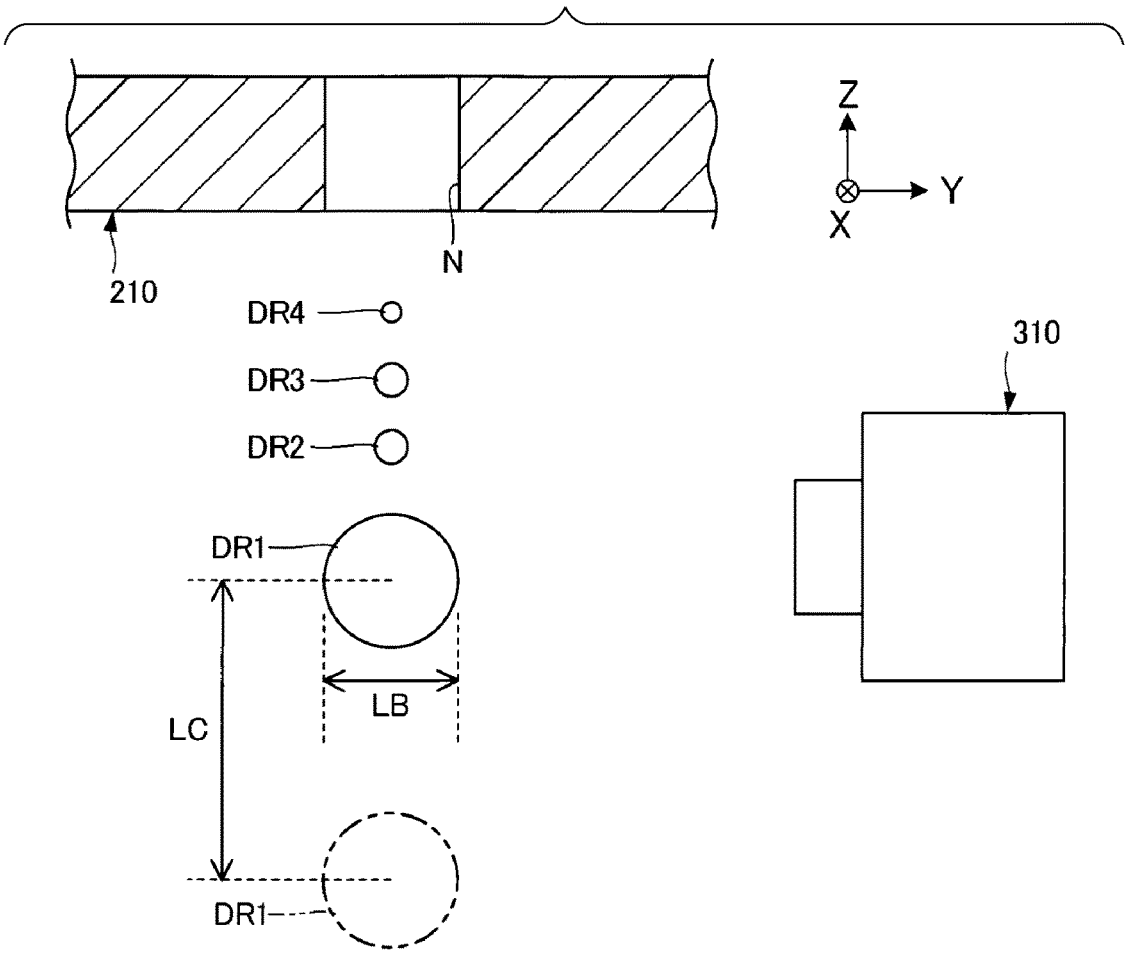
FIG. 6 is an explanatory diagram of abnormality determination using residual vibration.
FIG. 7 is an explanatory diagram of measurement of a flight state of ink.

FIG. 6 is an explanatory diagram of abnormality determination using the residual vibration. Presence or absence of any discharge abnormality using the residual vibration in FIG. 6 is determined, for example, based on potential information Is and time length information It, and a determination result Stt is generated as a result. The potential information Is is the information indicating the relationship between the potential and the threshold value potential in a predetermined one period Tc of the residual vibration signal NVT illustrated in FIG. 5. The time length information It is the information indicating the relationship between a time length Ntc and a threshold value in a predetermined one period Tc. In this regard, a predetermined one period Tc illustrated in FIG. 5 is measured based on a comparison result between the potential of the residual vibration signal NVT and a potential Vth-C of the amplitude center level of the residual vibration signal NVT.

In one period Tc, when the potential of the residual vibration signal NVT becomes equal to or higher than a threshold value potential Vth-H, which is higher than the potential Vth-C and lower than a threshold value potential Vth-L, which is lower than the potential Vth-C, the value of the potential information Is illustrated in FIG. 6 is set to "1". In other cases, the value of the potential information Is is set to "0".

Also, the time length Ntc of one period Tc is compared with each of a first threshold value Ntx1 representing a certain time length, a second threshold value Ntx2 representing a time length longer than the first threshold value Ntx1, and a third threshold value Ntx3 representing a time length longer than the second threshold value Ntx2.

As illustrated in FIG. 6, when the value of the potential information Is is "1", and the time length Ntc is less than the first threshold value Ntx1, the discharge determination section 295 determines that a discharge abnormality has been caused by bubbles. In this case, the value of the determination result Stt is set to "2". Also, when the value of the potential information Is is "1", and the time length Ntc is equal to or higher than the first threshold value Ntx1 and lower than or equal to the second threshold value Ntx2, the discharge determination section 295 determines that the discharge is normal. In this case, the value of the determination result Stt is set to "1". Also, when the value of the potential information Is is "1", and the time length Ntc is higher than the second threshold value Ntx2 and lower than or equal to the third threshold value Ntx3, the discharge determination section 295 determines that a discharge abnormality has been caused by adhesion of a foreign object to the nozzle N. In this case, the value of the determination result Stt is set to "3". Also, when the value of the potential information Is is "1", and the time length Ntc is higher than the third threshold value Ntx3, the discharge determination section 295 determines that a discharge abnormality has been caused by the viscosity of the ink. In this case, the value of the determination result Stt is set to "4". Also, when the value of the potential information Is is "0", the discharge determination section 295 determines that a discharge abnormality has been caused by not discharging ink, or the like. In this case, the value of the determination result Stt is set to "5".

In this manner, it is possible for the discharge determination section 295 to compare the quantified value of the amplitude and the period of the waveform of the residual vibration signal NVT indicating the discharge state value Sn and the threshold value so as to determine a discharge abnormality.

1.4 Measurement of Ink Flight State and Abnormality Determination Using Flight State FIG. 7 is an explanatory diagram of the measurement of the ink flight state. As illustrated in FIG. 7, the ink flight observation section 310 captures the image of the flight state of ink droplets DR1, DR2, DR3 and DR4 that have been discharged from the nozzle N of the liquid discharge head 210 from a direction perpendicular to or intersecting the discharge direction.

The droplet DR1 is a main droplet. In contrast, the droplets DR2, DR3 and DR4 are droplets having diameters smaller than the droplet DR1 and referred to as satellites. The ink discharge amount in the flight state, is, for example, calculated based on a diameter LB of the droplet DR1 by using the image captured by the ink flight observation section 310. Also, the ink discharge speed in the flight state, is calculated, for example, by consecutively capturing the images of the droplet DR1 and calculating based on a movement distance LC of the droplet DR1 after a predetermined time and the predetermined time. In FIG. 7, a droplet DR1 after a predetermined time is illustrated by a dash-double-dot line.

When it is not possible for the ink flight observation section 310 to observe an ink discharge, the discharge determination section 295 determines that a discharge abnormality, such as not discharging ink, or the like, occurs. Also, the discharge determination section 295 determines whether or not a discharge abnormality has occurred by comparing the threshold value range of the diameter LB of the droplet DR1, which is estimated by design, with the diameter LB of the actual droplet DR1.

In this manner, the discharge determination section 295 determines whether or not the diameter LB of the droplet DR1, and the like indicating the discharge state value Sn are in a predetermined threshold value range. Thereby, it is possible to determine a discharge abnormality.

1.5 Determination of Discharge Abnormality Based on Discharge Result

Although not illustrated in the figure, the discharge determination section 295 determines a discharge abnormality based on the discharge result by using the imaging result, and the like of the discharge result observation section 320. For example, when it is not possible to observe an ink discharge by using the imaging result, the discharge determination section 295 determines a discharge abnormality caused by not discharging ink, or the like has occurred. Also, the discharge determination section 295 compares the threshold value range of an ink area at the time of impact, which is estimated by design, with an actual ink area at the time of impact so as to determine whether or not the discharge is abnormal.

In this manner, the discharge determination section 295 determines whether or not an ink area at the time of impact, and the like indicating the discharge state value Sn are in a predetermined threshold value range. Thereby, it is possible to determine a discharge abnormality.

1.6 Learning Method

FIG. 8 is a diagram illustrating an example of a learning method performed by the learning device 400. The learning method illustrated in FIG. 7 includes steps S11 to step S13.

In step S11, the acquisition section 411 of the learning device 400 obtains a discharge state value Sn and a discharge result value Rn. In step S12, the acquisition section 411 obtains an image quality determination result D0. The memory circuit 420 stores the data set DS of the discharge state value Sn, the discharge result value Rn, and the image quality determination result D0. In this regard, the data set DS may be generated by the learning device 400 or a device other than the learning device 400, such as the liquid discharge apparatus 200, or the like. Also, when the data set DS is generated by the other device, step S11 and S12 are performed at the same time.

In step S13, the relationship between the discharge state value Sn and the discharge result value Rn, and the image quality determination result D0 is learned.

By performing the processing of steps S11 to S13 a plurality of times, a learned model PJ is generated as a result of learning the relationship between the discharge state values Sn and the discharge result values Rn, and the image quality determination results D0.

FIG. 9 is an explanatory diagram of the machine learning for generating a learned model PJ. The plurality of data sets DS are used for the machine learning of the learned model PJ. The image quality determination results D0 included in the data sets DS are labels corresponding to the correct answer values to the discharge state values Sn and the discharge result values Rn.

The learning section 412 sets a plurality of coefficients of the learned model PJ by the supervised machine learning using the plurality of data sets DS. Specifically, the learning section 412 updates the plurality of coefficients of the learned model PJ so as to reduce the difference between the image quality estimation result D0*x* output by a temporary learned model PJ with respect to the input of the discharge state value Sn and the discharge result value Rn in the data sets DS and the image quality determination result D0 included in the data sets DS. For example, the learning section 412 repetitively updates the plurality of coefficients of the learned model PJ by a backpropagation method so as to minimize the evaluation function representing the difference between the image quality estimation result D0*x* and the image quality determination result D0. The plurality of coefficients of the learned model PJ that have been set are stored in the memory circuit 420. The learned model PJ after performing the machine learning described above outputs a statistically reasonable image quality determination result D0 for unknown discharge state value Sn and discharge result value Rn under latent trends between the discharge state value Sn and the discharge result value Rn in a plurality of data sets DS, and the image quality determination result D0.

By the learning method described above, it is possible to learn the relationship between the discharge state value Sn and the discharge result value Rn, which are discharge parameters, and the image quality determination result D0. As a result, it is possible to generate a learned model PJ in consideration of various factors.

Here, the various threshold values used for determining the discharge abnormality are changed due to various factors, such as deterioration over time or changes in installation environment, and the like. Also, the various threshold value ranges used for determining the discharge abnormality are changed due to the discharge history or the discharge state of the adjacent nozzles N. For example, when the second nozzle N2 discharges ink while the first nozzle N1 is discharging ink, the time length of the period Tc of the residual vibration and the potential are changed. Accordingly, there are cases where the discharge is determined as abnormal even when the discharge is normal in reality. As a result, it is difficult to correctly determine the image quality. Thus, by using a learned model PJ generated by the above-described method, it is possible to correctly determine the image quality without mistakenly determining the discharge abnormality due to various factors.

Also, by using a learned model PJ, it is possible to identify a nozzle N that has a significant impact on the image quality. Accordingly, for example, when additional learning is performed by using the learned model PJ in the same manner as the learning method described above, it is possible to select a nozzle N to be used for learning the learned model PJ. As a result, it is possible to increase the accuracy of the additional learning. Accordingly, it is possible to generate a learned model PJ having a high determination accuracy of the image quality.

Also, as described above, by using the discharge state values Sn indicating the residual vibration or the flight state as the discharge state, it is possible to improve the determination accuracy of the image quality compared with the case of not using the values. In particular, by using the discharge state values Sn indicating the residual vibration, it is possible to increase the determination accuracy of the image quality.

Further, by using the discharge history as the discharge state or the discharge state value Sn indicating the state of the adjacent nozzle N, it is possible to correctly determine the image quality in consideration of the discharge history or whether or not the adjacent nozzle N discharges in addition to the residual vibration or the flight state.

Also, by using the discharge result value Rn, it is possible to correctly determine the image quality in consideration of various factors compared with the case of learning only the discharge state value Sn and the image quality determination result D0.

Also, it is possible to generate a learned model PJ having a higher determination accuracy of the image quality based on the contents of a combination of the discharge state value Sn and the discharge result value Rn obtained in step S11.

FIG. 10 is an explanatory diagram of combinations of the discharge state value Sn and the discharge result value Rn. The abnormality determination result based on the discharge state value Sn described above sometimes does not match the abnormality determination result based on the discharge result value Rn described above due to various factors. If the abnormality determination result based on the discharge state value Sn always matches the abnormality determination result based on the discharge result value Rn, it is desirable to generate a learned model PJ by using only either the abnormality determination result based on the discharge state value Sn or the abnormality determination result based on the discharge result value Rn from the viewpoint of simplification. In particular, when the two abnormality determination results match, it is possible to easily detect the discharge state value Sn, so that it is desirable to determine based on only the discharge state value S. However, the two abnormality determination results sometimes differ due to various factors. Accordingly, in the present embodiment, even when the abnormality determination results of these values differ, it becomes possible to determine the image quality with high accuracy based on the combinations of the discharge state value Sn and the discharge result value Rn. That is to say, by linking an image quality determination result D0 for each of the combinations of the discharge state value Sn and the discharge result value Rn, even when the discharge state value Sn differs from the discharge result value Rn, it is possible to determine the image quality with high accuracy. Further, by checking the degree of unmatched state between the discharge state value Sn and the discharge result value Rn, it is possible to obtain the accuracy of the abnormality determination due to the discharge state value Sn.

In the following, a description will be given of an example. As illustrated in FIG. 10, when the discharge determination section 295 determines that the discharge is normal based on the discharge state value Sn, and determines that the discharge is normal based on the discharge result value Rn, the learning section 412 determines that the contents of the combination of the discharge state value Sn and the discharge result value Rn are correct. At this time, the learning section 412 may add a weight to the data sets DS. Also, when the discharge determination section 295 determines that the discharge is abnormal based on the discharge state value Sn, and determines that the discharge is abnormal discharge result value Rn, the learning section 412 determines that the contents of the combination of the discharge state value Sn and the discharge result value Rn are correct. At this time, the learning section 412 the learning section 412 may add a weight to the data sets DS.

On the other hand, when the discharge determination section 295 determines that the discharge based on the discharge state value Sn is normal and determines that the discharge based on the discharge result value Rn is abnormal, the learning section 412 determines that the contents of the combination of the discharge state value Sn and the discharge result value Rn are wrong. At this time, the learning section 412 does not have to add a weight to the data sets DS. Also, when the discharge determination section 295 determines that the discharge based on the discharge state value Sn is abnormal, and determines that the discharge based on the discharge result value Rn is normal, the learning section 412 determines that the contents of the combination of the discharge state value Sn and the discharge result value Rn are wrong. At this time, the learning section 412 does not have to add a weight to the data sets DS.

In this manner, by responding to the contents of the combinations of the discharge state value Sn and the discharge result value Rn, it is possible to generate a learned model PJ having higher determination accuracy of the image quality while obtaining the accuracy of the abnormality determination by the discharge state value Sn.

In this regard, when the learning section 412 determines that the contents of the combination of the discharge state value Sn and the discharge result value Rn are wrong, the learning section 412 does not have to use the data sets DS including the discharge state value Sn and discharge result value Rn for the learning processing. In this case, when the learning section 412 determines that the contents of the combination of the discharge state value Sn and the discharge result value Rn are correct, the learning section 412 uses the data sets DS including the discharge state value Sn and discharge result value Rn for the learning processing.

With the machine learning system described above, it is possible to generate a learned model PJ having higher determination accuracy of the image quality.

2. Liquid Discharge System 500

2.1 Outline of Liquid Discharge System 500

Figure 11:
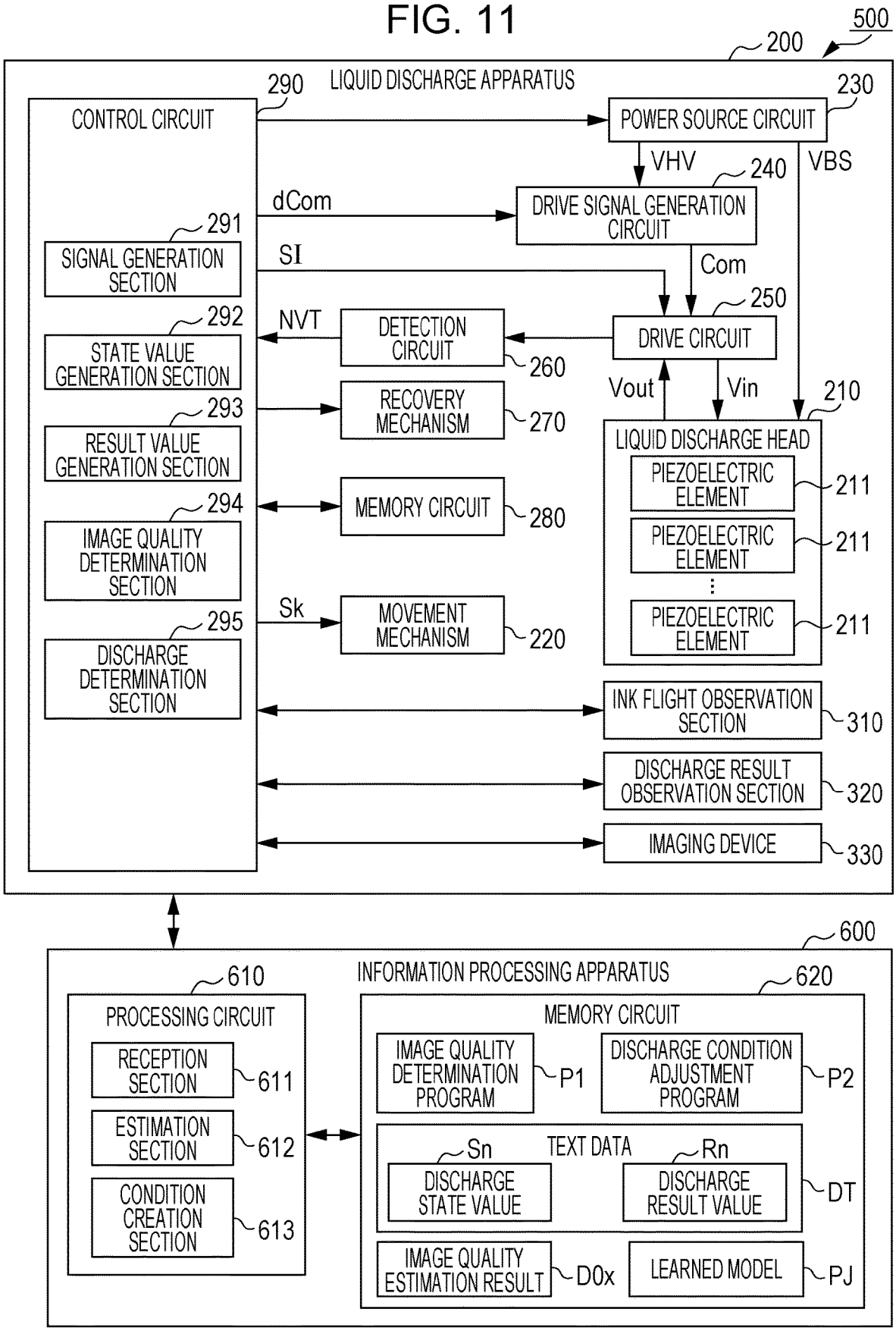
FIG. 11 is a diagram illustrating an example of a liquid discharge system according to an embodiment.

FIG. 11 is a dis illustrating an example of a liquid discharge system 500 according to an embodiment. In this regard, in the following each example, a component having the same function as that of the machine learning system 100 is given a sign used in the description of the machine learning system 100, and the detailed description will be suitably omitted.

As illustrated in FIG. 11, the liquid discharge system 500 includes the liquid discharge apparatus 200 described above and an information processing device 600. The liquid discharge apparatus 200 and the information processing apparatus 600 are connected wirelessly or wiredly in a communicable manner with each other. In this regard, the connection may include a communication network including the Internet. Also, in FIG. 11, the information processing apparatus 600 is a separate computer from the liquid discharge apparatus 200. However, the information processing apparatus 600 may be included in the liquid discharge apparatus 200. In this case, the liquid discharge device 200 includes the information processing apparatus 600. Also, the information processing apparatus 600 may be disposed in a cloud server.

The information processing apparatus 600 estimates the image quality by using a learned model PJ. Further, the information processing device 600 adjusts the discharge condition for discharging liquid based on the image quality estimated by the learned model PJ and the text data DT associated with the current discharge state value Sn and the current discharge result value Rn.

As illustrated in FIG. 11, the information processing apparatus 600 includes a memory circuit 620 and a processing circuit 610. These circuits are coupled with each other via a transmission line in a communicable manner with each other. In this regard, although not illustrated in FIG. 11, the information processing apparatus 600 includes a communication module that establishes a connection to the liquid discharge apparatus 200. Also, the information processing apparatus 600 may include a display device or an input device.

The memory circuit 620 is a device that stores various programs to be executed by the processing circuit 610 and various kinds of data to be processed by the processing circuit 610. The memory circuit 620 includes, for example, a hard disk drive or a semiconductor memory. In this regard, a part of or all of the memory circuit 620 may be disposed in an external storage device, a server, or the like outside the information processing apparatus 600. In this regard, a part of or all of the various programs and the various kinds of data may be stored in an external storage device, a server, or the like outside the information processing apparatus 600.

The memory circuit 620 has an image quality determination program P1, a discharge condition adjustment program P2, a plurality of text data DT, the learned model PJ described above, and the image quality estimation result D0*x*. The text data DT includes a current discharge state value Sn and a current discharge result value Rn. The current discharge state value Sn and the current discharge result value Rn are associated with each other. A current discharge state value Sn and a current discharge result value Rn are obtained for some nozzles N out of the plurality of nozzles N of the liquid discharge head 210. The learned model PJ is generated by the learning device 400 described above. The learned model PJ is a model for causing the information processing apparatus 600, which is a computer, to function so as to output the image quality estimation result D0*x* indicating the estimation of the image quality based on the text data DT.

The processing circuit 610 is a device having a function of controlling each section of the information processing apparatus 600 and a function of processing various kinds of data. The processing circuit 610 includes a processor, for example, a CPU, or the like. In this regard, the processing circuit 610 may be configured by a single processor or by a plurality of processors. Also, a part of or all of the functions of the processing circuit 610 may be realized by hardware, such as a DSP, an ASIC, a PLD, an FPGA, or the like.

The processing circuit 610 reads the image quality determination program P1 from the memory circuit 620 and executes the program. By the execution, the processing circuit 610 functions as a reception section 611 and a estimation section 612. Also, the processing circuit 610 reads the discharge condition adjustment program P2 from the memory circuit 620 and executes the program. By the execution, the processing circuit 610 functions as a condition creation section 613 in addition to the reception section 611 and the estimation section 612.

The reception section 611 receives input of the discharge state value Sn and the discharge result value Rn. The estimation section 612 estimates the image quality by using the learned model PJ based on the data set DS and generates an image quality estimation result D0*x*. The condition creation section 613 creates a discharge condition based on the learned model PJ, the data set DS, and the image quality estimation result D0*x*.

2.2 Image Quality Estimation Method

Figure 12:
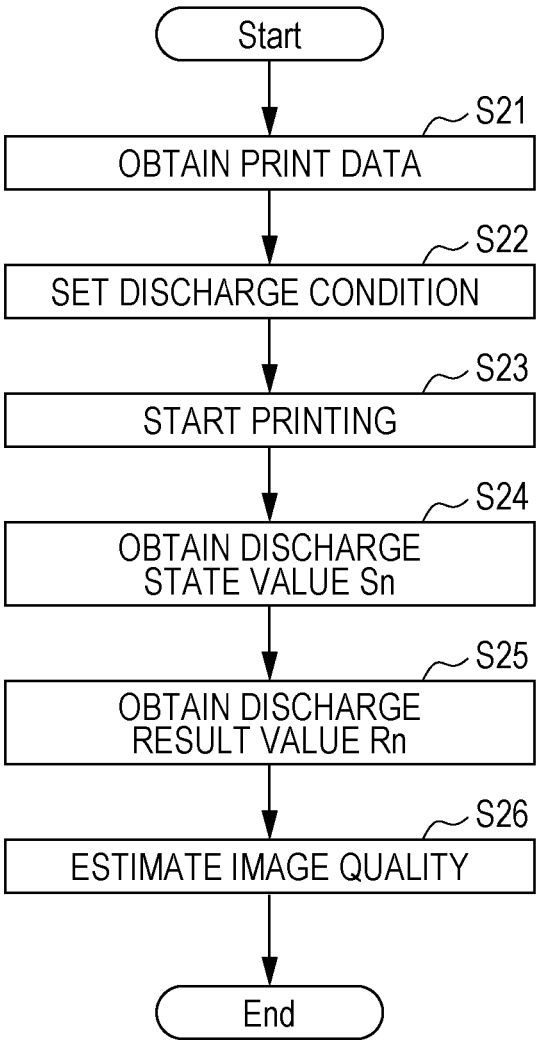
FIG. 12 is a diagram illustrating an example of an image quality determination method performed by the liquid discharge system.

FIG. 12 is a diagram illustrating an example of an image quality estimation method performed by the liquid discharge system 500. The image quality estimation method illustrated in FIG. 12 includes step S21 to step S26.

In step S21, the liquid discharge apparatus 200 obtains print data from an external device not illustrated in the figure. In step S22, the control circuit 290 of the liquid discharge apparatus 200 sets discharge conditions in accordance with the print data. Specifically, the control circuit 290 selects a nozzle to be used for discharging and sets the amount of ink as the discharge conditions. More specifically, the control circuit 290 sets various signals, such as the control signals Sk and SI, the waveform specification signal dCom, and the like as the discharge conditions. In step S23, the liquid discharge head 210 starts printing.

In step S24, the reception section 611 obtains the discharge state value Sn. In step S25, the reception section 611 obtains the discharge result value Rn. In this regard, the discharge state value Sn and the discharge result value Rn are repeatedly obtained until the printing is completed, and the memory circuit 620 stores text data DT including the discharge state value Sn and the discharge result value Rn. In this regard, the reception section 611 may obtain the discharge state value Sn and the discharge result value Rn every time during the printing, or may obtain the discharge state value Sn and the discharge result value Rn after the printing is completed. Also, the processing of steps S23 and S24 may be performed at the same time.

In step S26, the estimation section 612 estimates the image quality by using the learned model PJ based on the discharge state value Sn and the discharge result value Rn, and generates an image quality estimation result D0*x*. In step S26, the image quality estimation result D0*x* is transmitted to the liquid discharge apparatus 200. The transmitted result is displayed, for example, so as to be visually recognized by a user by using a display device of the liquid discharge apparatus 200, which is not illustrated in the figure.

For example, a mathematical model, such as a neural network, or the like is suitably used for the learned model PJ. The learned model PJ includes an input layer, an output layer, and one or more intermediate layers. The text data DT is input to the input layer as input data. That is to say, the discharge state value Sn and the discharge result value Rn are input to the input layer. Also, the image quality estimation result D0*x* indicating the estimated result of the image quality is output from the output layer.

In the above-described image quality estimation method, the image quality to be printed is estimated based on the current discharge state value Sn and the current discharge result value Rn by using the learned model PJ described above. Accordingly, it is possible to correctly determine the image quality regardless of the determination errors of the discharge abnormality caused by various factors.

2.3 Discharge Condition Adjustment Method

Figure 13:
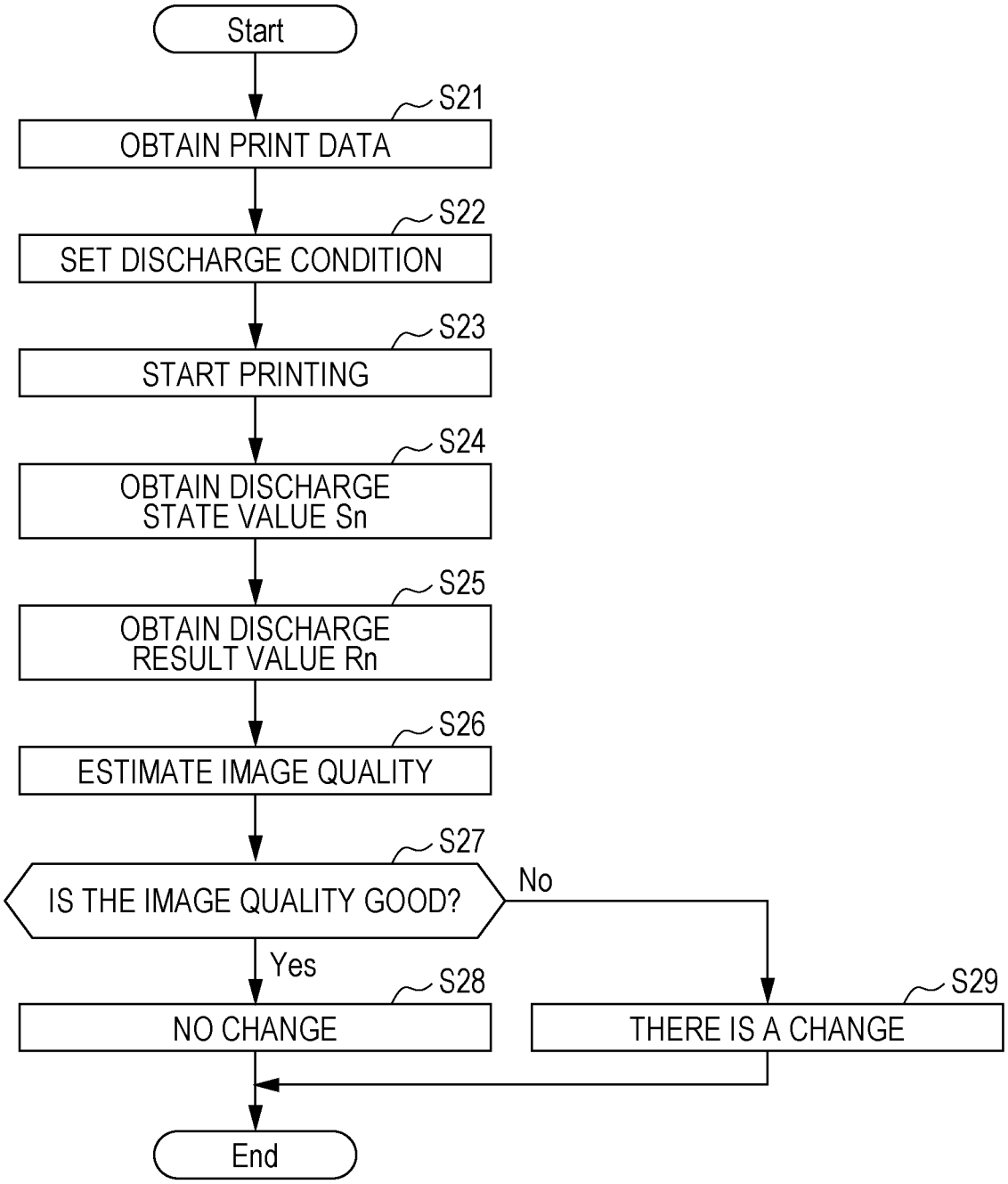
FIG. 13 is a diagram illustrating an example of a discharge condition adjustment method performed by the liquid discharge system.

FIG. 13 is a diagram illustrating an example of the discharge condition adjustment method performed by the liquid discharge system 500. The discharge condition adjustment method illustrated in FIG. 13 includes the processing of steps S21 to S28. In this regard, the processing of steps S21 to S26 is the same as that described by the image quality estimation method described above.

In step S27, the condition creation section 613 determines whether or not the image quality is "good" based on the image quality estimation result D0*x*.

In step S28, when the image quality is "good", the condition creation section 613 generates information indicating not changing the discharge condition by keeping the current discharge condition as it is. In this regard, the information processing apparatus 600 outputs the information to the liquid discharge apparatus 200. Also, in step S29, when the image quality is not "good", the condition creation section 613 generates information indicating a change in the current discharge condition. Further, the condition creation section 613 changes the selection of a nozzle to be used for discharging and the discharge conditions, such as setting the ink amount, and the like based on the learned model PJ, the image quality estimated using the learned model PJ, the current discharge state value Sn, and the current discharge result value Rn. Also, the condition creation section 613 may generate information indicating the execution of flushing processing performed by the recovery mechanism 270, wiping processing for wiping the nozzle face of the nozzle N, and the like. In this regard, the information processing apparatus 600 outputs the information indicating the changed discharge condition to the liquid discharge apparatus 200. Also, the control circuit 290 of the liquid discharge apparatus 200 may create a part of the conditions created by the condition creation section 613.

As described above, by the discharge condition adjustment method described above, the discharge conditions for discharging liquid are adjusted based on the learned model PJ described above, the image quality estimated by using the learned model PJ, and the current discharge state value Sn and the current discharge result value Rn. Accordingly, it is possible to generate discharge conditions for obtaining excellent image quality.

Also, a weight in accordance with the contents of the combination of the current discharge state value Sn and the current discharge result value Rn, which are obtained in steps S24 and S25, may be added to the text data DT. Specifically, as illustrated in FIG. 10, when the abnormality determination result based on the current discharge state value Sn does not match the abnormality determination result based on the current discharge result value Rn, a weight may not be added to the text data DT, whereas when these values match, a weight may be added to the text data DT.

In this manner, by adding a weight in accordance with the contents of the combination of the current discharge state value Sn and the current discharge result value Rn, it is possible to increase the estimation accuracy of the image quality compared with the case of equally handling all the text data DT. Also, it is possible to adjust an optimum discharge condition.

In this regard, when the abnormality determination result based on the current discharge state value Sn does not match the abnormality determination result based on the current discharge result value Rn, the text data DT including the discharge state value Sn and the discharge result value Rn do not have to be used for the image quality estimation processing and the discharge condition adjustment processing.

In the above, the descriptions have given of the present disclosure based on the embodiments illustrated in the figures. However, the present disclosure is not limited to these. Also, it is possible to replace the component of each section of the present disclosure by any component that performs the same function as that of the embodiments described above and to add any other components. Also, it may be possible to configure the present disclosure by combining any component of each of the embodiments described above.

What is claimed is:

1. A machine learning method comprising:

obtaining a discharge parameter on discharging performed by a liquid discharge head discharging liquid;

obtaining an image quality determination result produced by determining a printed image quality;

obtaining a learned model produced by learning a relationship between the discharge parameter on discharging performed by a liquid discharge head discharging liquid and the image quality determination result produced by determining a printed image quality, wherein the discharge parameter includes a current discharge state value indicating a discharge state of the liquid discharge head and a current discharge result value indicating a discharge result of liquid discharged on a print medium from the liquid discharge head; and adjusting a discharge condition for discharging liquid based on the estimated quality of the image, the learned model, the current discharge state value, and the current discharge result value.

2. The machine learning method according to claim 1, further comprising:

generating a data set associating the discharge state value and the discharge result value with the image quality determination result, and adding a weight in accordance with contents of a combination of the discharge state value and the discharge result value to the data set.

3. The machine learning method according to claim 1, further comprising:

determining whether the discharging is normal or abnormal based on the discharge state value;

determining whether the discharging is normal or abnormal based on the discharge result value; and when the discharging based on the discharge state value is normal, and the discharging based on the discharge result value is normal, or the discharging based on the discharge state value is abnormal, and the discharging based on the discharge result value is abnormal, determining that a combination of the discharge state value and the discharge result value is correct, whereas when the discharging based on the discharge state value is normal, and the discharging based on the discharge result value is abnormal, or the discharging based on the discharge state value is abnormal, and the discharging based on the discharge result value is normal, determining that a combination of the discharge state value and the discharge result value is wrong.

4. The machine learning method according to claim 1, wherein the liquid discharge head includes a first nozzle, a first pressure chamber communicating with the first nozzle, and a first drive element giving pressure on liquid in the first pressure chamber by being applied with a drive signal, and the discharge state includes at least one of residual vibration occurring in the first pressure chamber after supplying the drive signal to the first drive element and a flight state of liquid discharged from the first nozzle.

5. The machine learning method according to claim 4, wherein the liquid discharge head includes a second nozzle, a second pressure chamber communicating with the second nozzle, and a second drive element giving pressure on liquid in the second pressure chamber by being applied with a drive signal, and the discharge state further includes at least one of a discharge history of the first nozzle and presence or absence of discharging from the second nozzle at the time of discharging liquid from the first nozzle.

6. The machine learning method according to claim 1, wherein the discharge result includes at least one of presence or absence of impact of liquid on a print medium and an impact state of liquid impacted on the print medium.

7. A non-transitory computer-readable storage medium storing a machine learning program, the machine learning program causing a computer to perform functions comprising:

obtaining a discharge parameter on discharging performed by a liquid discharge head discharging liquid;

obtaining an image quality determination result produced by determining a printed image quality;

obtaining a learned model produced by learning a relationship between the discharge parameter on discharging performed by a liquid discharge head discharging liquid and the image quality determination result produced by determining a printed image quality, wherein the discharge parameter includes a current discharge state value indicating a discharge state of the liquid discharge head and a current discharge result value indicating a discharge result of liquid discharged on a print medium from the liquid discharge head;

adjusting a discharge condition for discharging liquid based on the estimated quality of the image, the learned model, the current discharge state value, and the current discharge result value.

8. A liquid discharge system comprising:

a learned model obtaining unit that obtains a learned model produced by learning a relationship between a discharge parameter on discharging performed by a liquid discharge head discharging liquid and an image quality determination result produced by determining a printed image quality;

a current parameter obtaining unit that obtains, as a current discharge parameter, the current discharge state value indicating a discharge state of the liquid discharge head and the current discharge result value indicating a discharge result of liquid discharged on a print medium from the liquid discharge head;

an estimation unit that estimates a quality of an image to be printed by using the learned model based on the current discharge parameter; and an adjustment unit that adjusts a discharge condition for discharging liquid based on the estimated quality of the image, the learned model, the current discharge state value, and the current discharge result value.

9. The liquid discharge system according to claim 8, wherein the estimation unit estimates a quality of an image to be printed by using the learned model based on the current discharge state value and the current discharge result value.

* * * * *